United States Patent [19]

Molyneux-Berry

[11] Patent Number: 4,494,167

[45] Date of Patent: Jan. 15, 1985

[54] INDUCTOR

[75] Inventor: Robert B. Molyneux-Berry, Danbury, England

[73] Assignee: The Marconi Company Limited, Chelmsford, England

[21] Appl. No.: 364,965

[22] Filed: Apr. 2, 1982

[30] Foreign Application Priority Data

Apr. 3, 1981 [GB] United Kingdom ..... 8110602

[51] Int. Cl.[3] ..... H01H 9/22

[52] U.S. Cl. ..... 361/270; 361/268

[58] Field of Search ..... 361/268, 270; 336/180, 336/181, 184, 185; 330/190, 197, 170

[56] References Cited

U.S. PATENT DOCUMENTS

| | | | |
|---|---|---|---|
| 757,525 | 4/1904 | Varley | 361/268 X |
| 2,088,454 | 7/1937 | Whisk | 361/270 X |
| 2,412,102 | 12/1946 | Spengler | 361/268 X |
| 2,980,757 | 4/1961 | Coggeshall et al. | 336/185 X |
| 3,274,527 | 9/1966 | Robinson | 336/69 |

FOREIGN PATENT DOCUMENTS

| | | |
|---|---|---|
| 266985 | 12/1968 | Austria . |
| 897860 | 10/1953 | Fed. Rep. of Germany . |
| 2544481 | 9/1977 | Fed. Rep. of Germany . |
| 322500 | 12/1929 | United Kingdom . |
| 515626 | 12/1939 | United Kingdom . |
| 574778 | 1/1946 | United Kingdom . |
| 578093 | 6/1946 | United Kingdom . |
| 983481 | 2/1965 | United Kingdom . |
| 1163027 | 4/1969 | United Kingdom . |

*Primary Examiner*—Reinhard J. Eisenzopf

*Attorney, Agent, or Firm*—Spencer & Frank

[57] ABSTRACT

An inductor included as part of a pulse width modulation amplifier is formed by four coils 9A, 9B, 9C and 9D arranged alongside each other and connected in parallel. The coils are supported against electromotive forces tending to pull them together by insulating strips 10. The coils are enclosed within an electromagnetic shield formed by a cabinet 1. Because of the arrangement of the coils the magnetic field generated by them is confined to a region in the close vicinity of the coils, so that the losses which would otherwise occur as a result of the proximity of the shield or other cabinet are reduced to a minimum. Thus the efficiency of the inductor formed by the combined coils is greater than would be the efficiency of a single coil within the same cabinet, this latter arrangement being conventional.

19 Claims, 1 Drawing Figure

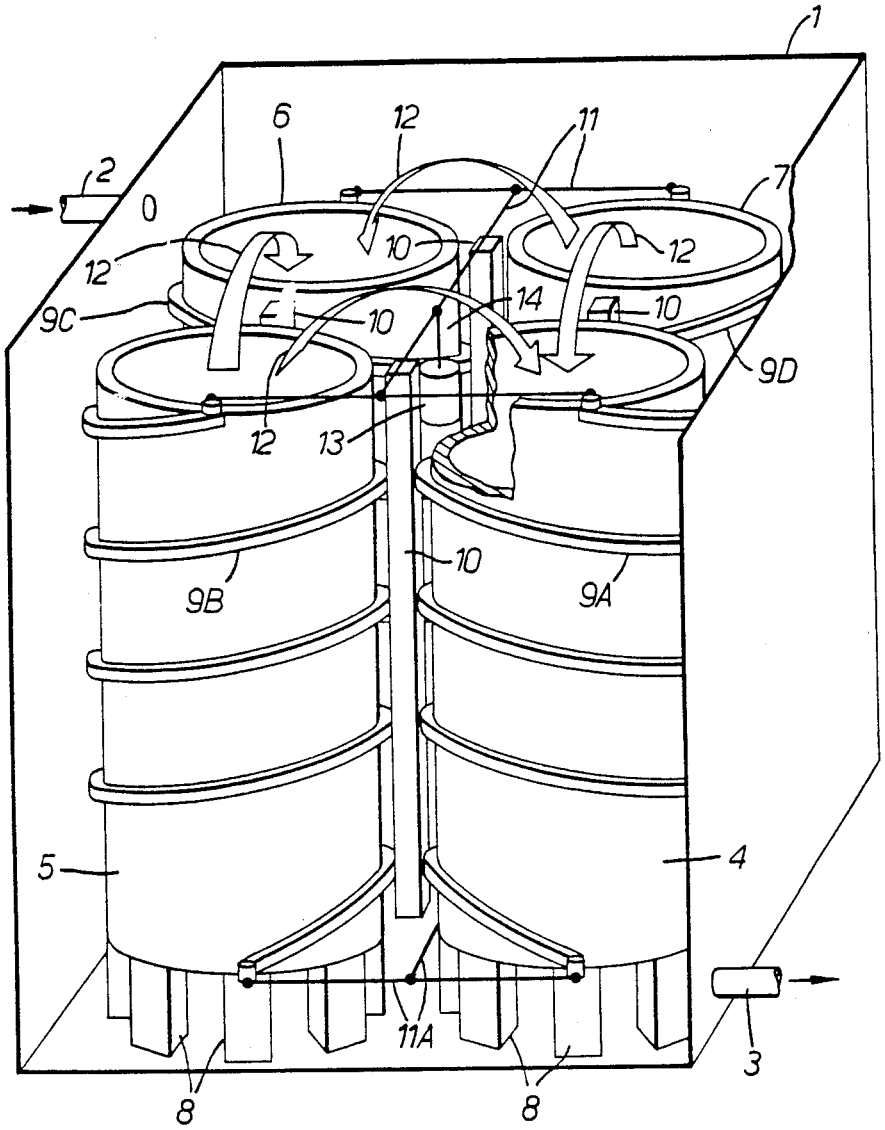
1
2
0
6
12
11
7
12
10
12
9C
10
14
10
9D
12
13
10
9B
9A
5
4
11A
3
8
8

INDUCTOR

BACKGROUND OF THE INVENTION

This invention relates to an inductor particularly though not exclusively for use in a pulse width modulation amplifier.

Pulse width modulation amplifiers designed for use in broadcasting equipment incorporate inductors required to carry very heavy currents. It is therefore an important requirement that such inductors should produce as low a percentage of power loss as possible and therefore need to have a high Q factor.

It is well known that single circular coils of certain dimensions, e.g. the diameter being twice the length, have an optimum Q factor and that all other arrangements are inferior, although such other arrangements may be imposed upon the design where for practical reasons there is a limitation on physical dimensions. Thus, single circular coils have been used in the past.

Single coils inevitably generate external magnetic and electric fields which are liable to induce undesirable effects in nearby equipment. This is commonly avoided by enclosing the coil in a screen which may be formed by a metal cabinet.

SUMMARY OF THE INVENTION

The present invention arose from a realisation that, unless the cabinet or other screen is spaced well clear of the coil itself, (which may not be possible in practice) coupling between the inductor and the screen will cause deterioration in the Q factor and may adversely influence other desired characteristics, e.g. inductance value and self resonant frequency. Because of these effects the well established design considerations are now believed to be at least partially invalid.

According to one aspect the invention provides an inductor comprising two coils wound in opposite directions, connected in parallel and arranged so that, when the coils are energised, a magnetic circuit passes between them, the inductor being enclosed within a conductive enclosure constituting an electromagnetic shield.

By employing the invention the magnetic and electric fields can be concentrated in the region of the coils themselves thereby reducing adverse effects caused by induction of currents in the cabinet or other shielding member. Consequently, even though the two or more coils provided in accordance with the invention may not be ideal from a theoretical point of view which ignores the presence of the shielding material, when the shielding material is taken into consideration the overall losses may be considerably less than had a single coil been used in the same enclosure.

Furthermore, because the coils are wound in opposite directions, their magnetic effects at positions away from the immediate vicinity of the coils tend to cancel thereby reducing the resultant magnetic field. This not only reduces losses in the conductive enclosure but also reduces any magnetic field which may appear outside the latter.

According to another aspect of the invention there is provided an inductor comprising a group of at least four coils connected in parallel and having different substantially parallel axes, each coil being wound in the same direction as an opposite coil of the group but in the opposite direction as adjacent coils.

Because of the arrangement of the coils there can be expected to be considerable forces attracting them together and in order to support these forces an insulator is preferably provided between the coils, extending longitudinally so as to support them against the aforementioned forces at a plurality of positions along their lengths. Such support is best provided if conductors forming the windings are of rectangular or square cross section and arranged so that they touch immediately opposite portions of the aforementioned longitudinal insulator. The square or rectangular cross section is also of benefit in reducing the risk of the windings slipping on their respective formers.

Whilst any even number of coils may be provided, (more complex arrangements can employ an odd number of geometrically dissimilar coils) the preferred number is four: arranged to form four pairs of adjacent coils. In such an arrangement it is notable that there is a space at the centre of the arrangement of coils where there is negligible or no magnetic field and any electric field due to a potential difference across the coils is uniformly graded. This fact can be made use of by locating in that space a capacitor connected in parallel with the inductors. Such a capacitor may be employed in pulse width modulation amplifiers, e.g. to tune the resonance of the inductor to a specific frequency and would be adversely effected if located elsewhere within the cabinet at a position where it would be intersected by powerful electric and magnetic fields. Preferably a plurality of such capacitors are connected in series to withstand a high working voltage of the amplifier. Those capacitors may be positioned within the aforementioned space so that the uniformly graded electric field due to the coils is in harmony with the applied potential divided between the series connected capacitors. It is possible that it may be useful also to position other components in the space between the coils.

BRIEF DESCRIPTION OF THE DRAWINGS

The single FIGURE is a perspective side view, partially cut-away, illustrating an inductor constructed in accordance with the invention for use in a pulse width modulation amplifier forming part of a radio transmitter.

DESCRIPTION OF THE PREFERRED EMBODIMENT

Referring to the drawing, the illustrated equipment comprises a steel cabinet 1 which forms a suitable shield to protect apparatus located outside the cabinet from electric and/or magnetic fields. The front and top panels of the cabinet are not shown so as to reveal the interior components. The cabinet has an air inlet 2 and an air outlet 3 to provide for cooling. Inside the cabinet are four cylindrical formers 4, 5, 6, and 7 made from resin bonded fibre glass and these insulating formers are supported on insulators 8. The formers 4, 5, 6, and 7 are wound with coils 9A, 9B, 9C and 9D respectively, each of these coils consisting of a single layer winding of a rectangular cross section copper strip. It can be seen from the drawing that adjacent coils, i.e. coils 9A and 9B, coils 9B and 9C, coils 9C and 9D and coils 9D and 9A, are wound in opposite directions, i.e. they have opposite handedness.

The coils have no magnetic core or yoke, the spaces inside the coils and between the coils and the cabinet 1 being filled with a non-magnetic material, which in this case is air.

Adjacent coils are separated by insulating strips 10 which may be made of any suitable material such as rubber or synthetic plastics material, these strips extending longitudinally of the coils so that the latter are supported at each turn against forces tending to draw them together. It will be noted in this connection that adjacent coils touch the insulating strips 10 at positions immediately opposite each other. This, and the rectangular cross section of the conductors of the coils, ensure a firm supporting action. In one alternative embodiment of the invention the conductors forming the coils have an insulating coating and are close-wound.

Adjacent ends of all the coils are connected by conductive copper bars 11 and 11A (shown schematically) so that they are all connected in parallel. Thus, when a potential is applied to terminals, not shown, connected to the respective bars 11 and 11A the resulting currents passing through all the coils produce four magnetic circuits, each passing through a respective pair of the coils as indicated by the arrows 12. These magnetic fields are, to a large extent, confined to a region in close proximity with the coils thereby minimizing losses caused by the proximity of the cabinet. The magnetic circuit thus passes through non-magnetic material (air), is not significantly influenced by the presence of magnetic materials, and does not to a substantial extent intersect a conductive housing. The result is that the inductor produces a relatively low loss compared with that which would be encountered if a single coil built according to conventional theory, and of the same inductance as the four combined coils illustrated, were located in the same cabinet. The residual external electromagnetic field, due to inevitable imperfections in the cabinet, is also much reduced.

The coil 9A and its former are shown partly broken away to reveal one capacitor 13 belonging to a line of series-connected capacitors extending in a space 14 between the coils along a central axis of the group of coils. In this space 14 there is no magnetic field and the capacitors 13 are thus immune from magnetic effects. The line of capacitors is connected in parallel with the coil to the bars 11 and 11A.

I claim:

1. An inductor arranged within a conductive enclosure, comprising: two equal coils wound in opposite directions and positioned adjacent each other, the coils having axes that are substantially parallel and having adjacent ends that are connected directly together so that the coils are connected electrically in parallel, the coils being mounted in the enclosure so that the lines of magnetic force produced when the coils are energized form closed loops which link both coils without the agency of magnetic materials and which substantially avoid intersecting the walls of the enclosure.

2. An inductor according to claim 1, further comprising an insulator extending longitudinally of the coils and serving to hold them apart against electromotive forces tending to attract them together.

3. An inductor according to claim 1 in which the conductive enclosure is a cabinet.

4. An inductor in accordance with claim 1 or 2, wherein the conductors forming the coils are of rectangular cross section.

5. An inductor according to claim 4, further comprising a circuit component located in a space between the coils.

6. An inductor according to claim 5, wherein said component is a capacitor connected in parallel with the coils.

7. An inductor according to claim 6, in which the coils are air cooled.

8. An inductor, comprising: a group of four coils connected electrically in parallel and having different substantially parallel axes passing through respective corners of a quadrilateral, each coil being wound in the same direction as a coil whose axis passes through an opposite corner of the quadrilateral but in the opposite direction as coils whose axes are at adjacent corners of the quadrilateral.

9. An inductor according to claim 8, wherein the combined inductance of those coils which are wound in one direction is equal to the combined inductance of those coils which are wound in the opposite direction.

10. An inductor arranged within a conductive enclosure, comprising:

two equal coils wound in opposite directions and positioned adjacent each other, the coils having axes that are substantially parallel and having adjacent ends that are connected directly together so that the coils are connected electrically in parallel, the coils being mounted in the enclosure so that the lines of magnetic force produced when the coils are energized form closed loops which link both coils without the agency of magnetic materials and which substantially avoid intersecting the walls of the enclosure; and an additional two equal coils that are wound in opposite directions and positioned adjacent each other within the enclosure, said additional two coils being electrically connected in parallel with said two coils so as to form an inductor which includes four coils.

11. An inductor in accordance with claim 10, wherein the conductors forming the coils are of rectangular cross section.

12. An inductor according to claim 11, further comprising a circuit component located in a space between the coils.

13. An inductor according to claim 12, wherein said component is a capacitor connected in parallel with the coils.

14. An inductor according to claim 13, in which the coils are air cooled.

15. An inductor arranged within a conductive enclosure, comprising:

two equal coils wound in opposite directions and positioned adjacent each other, the coils having axes that are substantially parallel and having adjacent ends that are connected directly together so that the coils are connected electrically in parallel, the coils being mounted in the enclosure so that the lines of magnetic force produced when the coils are energized form closed loops which link both coils without the agency of magnetic materials and which substantially avoid intersecting the walls of the enclosure; and a plurality of additional coil pairs that are wound in opposite directions and positioned adjacent each other within the enclosure, said plurality of additional coil pairs being electrically connected in parallel with said two coils so as to form an inductor which includes an even number of coils in excess of four.

16. An inductor in accordance with claim 15, wherein the conductors forming the coils are of rectangular cross section.

17. An inductor according to claim 16, further comprising a circuit component located in a space between the coils.

18. An inductor according to claim 17, wherein said component is a capacitor connected in parallel with the coils.

19. An inductor according to claim 18 in which the coils are air cooled.

* * * * *